United States Patent [19]

Okabe et al.

[11] 4,299,607

[45] Nov. 10, 1981

[54] PROCESS FOR RECOVERING NITROGEN IN LOW PRESSURE TYPE AIR SEPARATION APPARATUS

[75] Inventors: Michimasa Okabe; Shozi Koyama, both of Kudamatsu, Japan

[73] Assignee: Hitachi, Ltd., Tokyo, Japan

[21] Appl. No.: 149,630

[22] Filed: May 14, 1980

[30] Foreign Application Priority Data

May 16, 1979 [JP] Japan ..... 54-59128
Jan. 23, 1980 [JP] Japan ..... 55-5764

[51] Int. Cl.[3] ..... F25J 3/04
[52] U.S. Cl. ..... 62/13; 62/39
[58] Field of Search ..... 62/13–15, 62/38, 39

[56] References Cited

U.S. PATENT DOCUMENTS 3,735,599 5/1973 Izumichi et al. ..... 62/13
3,736,762 6/1973 Toyama et al. ..... 62/13

*Primary Examiner*—Norman Yudkoff
*Attorney, Agent, or Firm*—Craig and Antonelli

[57] ABSTRACT

In a low pressure type air separation apparatus provided with a reversing heat exchanger for removing water vapor and carbon dioxide gas in feed air, a nitrogen gas taken out of a high pressure column in a duplex type rectification tower is led to an expander for generating subcooling for the air separation apparatus, and the effluent nitrogen gas is obtained under a predetermined pressure by controlling a pressure of the effluent gas from the expander. The effluent nitrogen gas is adjusted to a temperature satisfactory for the inlet temperature conditions for the reversing heat exchanger by passing the effluent nitrogen gas through a heat exchanger, and then is passed through the reversing heat exchanger, whereby the effluent gas from the reversing exchanger is obtained as a product nitrogen gas under a predetermined pressure.

7 Claims, 2 Drawing Figures

PROCESS FOR RECOVERING NITROGEN IN LOW PRESSURE TYPE AIR SEPARATION APPARATUS

BACKGROUND OF THE INVENTION

1. Field of the Invention

The present invention relates to a process for recovering nitrogen in a low pressure type air separation apparatus provided with a reversing heat exchanger for removing water vapor and carbon dioxide gas from feed air, which is applicable to recovery of a product nitrogen gas under a predetermined pressure higher than the pressure of a nitrogen gas taken out of a low pressure column of duplex type rectification tower, but lower than the pressure of a nitrogen gas directly taken out of a high pressure column of the duplex type rectification column.

2. Prior Art

When a nitrogen gas from a high pressure column (which will be hereinafter referred to as "lower column") of duplex type rectification tower is used as a feed fluid for an expander in a low pressure type air separation apparatus using a reversing heat exchanger, the nitrogen gas is adiabatically expanded down to a pressure of a low pressure column (which will be hereinafter referred to as "upper column") of the duplex type rectification tower to increase the subcooling generation in the expander, and the effluent nitrogen gas from the expander is mixed with a low pressure product nitrogen from the upper column or a waste nitrogen gas according to the conventional process.

Recently a demand for nitrogen is increasing in various fields, and its application purposes are made versatile by employing new systems, etc. The pressure of a nitrogen gas recovered in the low pressure air separation apparatus is generally 100–500 mm Aq when the nitrogen gas is taken out of the upper column. When a nitrogen gas under a superatmospheric pressure is required, a nitrogen gas can be directly taken out of the lower column and supplied under a pressure of 4–5 $kg/cm^2$ gage. However, in the latter case, it is necessary to increase the rate of feed air to meet the required pressure, and this is disadvantageous from the viewpoint of power requirement. Recently there is a demand for an air separation apparatus capable of recovering the nitrogen gas under a relatively low pressure of 0.5–2 $kg/cm^2$ gage, depending upon application purposes.

To meet such a demand in the conventional low pressure type air separation apparatus, another nitrogen compressor is required in taking the nitrogen gas from the upper column, whereas the pressure becomes higher than required in directly taking the nitrogen gas from the lower column, resulting in an increase in power loss.

Furthermore in the low pressure type air separation apparatus using a reversing heat exchanger, it is necessary to control the temperature of return gas such as nitrogen gas, etc. to a specific temperature because of a sublimation problem of carbon dioxide gas in the reversing heat exchanger. For this purpose, two heat exchangers are provided at the outlet of the expander, where one of the heat exchangers serves as a heat exchanger for elevating the temperature of the effluent gas from the expander if it is lower than the inlet temperature of the reversing heat exchanger, and another serves as a heat exchanger for cooling if it is too high. However, the provision of two heat exchangers and switching a high temperature fluid to a low temperature fluid or vice versa to control the temperature of the effluent gas from the expander are not only expensive from the viewpoint of apparatus, but also complicated from the viewpoint of automatic temperature control, and thus this system has not actually been employed yet.

According to one actually employed example, another passage is provided at a liquefier in the waste nitrogen line from the upper column and employed without any automatic control on the basis of the fact that the saturation temperature of air in the lower column is not changed. This system is applicable to the apparatus of not so large scale without any problem, but in the case of the apparatus of large scale, a heat transfer area must be increased because of the gas-gas heat exchange in the heat exchanger, and thus the system is disadvantageous in cost.

THE SUMMARY OF THE INVENTION

An object of the present invention is to effectively utilize adiabatic expansion of a nitrogen gas with an excess pressure energy from the lower column through an expander in a low pressure type air separation apparatus using a reversing heat exchanger, thereby generating subcooling by expanding the nitrogen gas from the lower column through the expander to a predetermined pressure higher than that of the low pressure nitrogen gas from the upper column but lower than that of the nitrogen gas directly taken out of the lower column.

Another object of the present invention is to control the temperature of the effluent gas from the expander to the inlet temperature necessary for the reversing heat exchanger through a heat exchanger, irrespectively of higher or lower temperature of the effluent gas from the expander.

According to the present invention, a product nitrogen gas under a predetermined pressure is obtained in a low pressure type air separation apparatus using a reversing heat exchanger by passing the nitrogen gas from the lower column of duplex type rectification tower through an expander, a control device for controlling the pressure of product nitrogen gas, that is, the pressure at the outlet of the expander, and a heat exchanger for adjusting the temperature of the effluent nitrogen gas from the expander to an inlet temperature of the reversing heat exchanger.

PREFERRED EMBODIMENTS OF THE INVENTION

Figure 1:
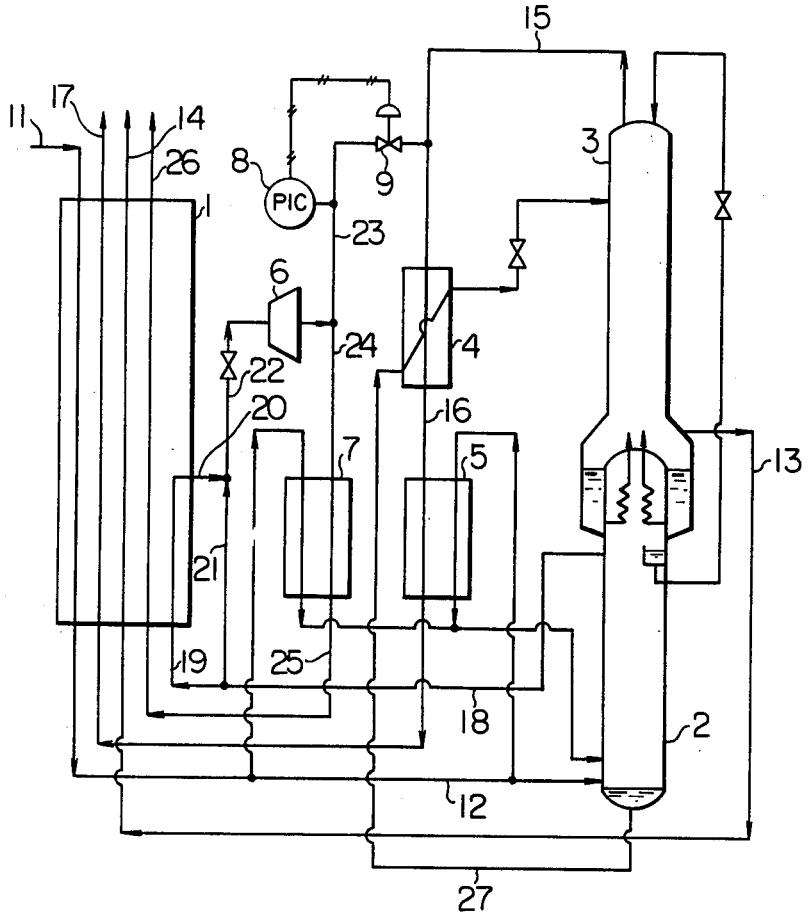
FIG. 1 is a schematic flow diagram showing one embodiment of a low pressure type air separation apparatus with nitrogen recovery according to the present invention.

One embodiment of the present invention will be described in detail below, referring to FIG. 1.

At the startup of an air separation apparatus, compressed feed air is cooled through heat exchange with low temperature return gas in a reversing heat exchanger 1 through a conduit 11, and led to a lower column 2 of duplex type rectification tower through a conduit 12. Then, the feed air in the lower column 2 is led to an expander 6 through conduits 18–22 and expanded therein to become cold air, and the resulting cold air is led to the reversing heat exchanger 1 through a conduit 24, a heat exchanger 7 and a conduit 25 to cool the incoming feed air, and vented to the atmosphere. The feed air and the entire apparatus are gradually cooled by the startup operation, and the startup operation is shifted to stationary operation.

Apart from the above-mentioned startup operation, the startup operation can be carried out by connecting the conduit 12 for the feed air from the reversing heat exchanger 1 to the conduit 18 to directly introduce the feed air into the expander 6, and then can be shifted to stationary operation.

In the stationary operation, the compressed feed air is heat exchanged with a low temperature separated gas in the reversing heat exchanger 1 through the conduit 11 to remove water vapor and carbon dioxide gas in the feed air by deposition, cooled approximately to a saturation temperature, and injected into the lower column 2 of duplex type rectification tower through the conduit 12. Oxygen rectified and separated in the duplex type rectification tower is taken out of an upper column 3 at the lower part through a conduit 13, passed through the reversing heat exchanger 1 to recover the temperature up to room temperatue, and taken out as a product through a conduit 14.

On the other hand, waste nitrogen is taken out of the upper column 3 at the upper part through a conduit 15, heat exchanged in a supercooler 4 with liquefied air to be fed to the upper column 3 from the lower column 2 through a conduit 27 to elevate the temperature, further led to a liquefier 5 through a conduit 16 and heat exchanged therein with a portion of feed air branched from the conduit 12, thereby elevating its temperature to a satisfactory inlet temperature of the reversing heat exchanger 1, and led to the reversing heat exchanger 1. The waste nitrogen is passed through a passage which periodically alternates with the incoming feed air in the reversing heat exchanger, heat exchanged with the feed air, thereby elevating its temperature to room temperature and simultaneously sublimating the ice and solid carbon dioxide deposited on the heat exchanger, and vented to the atmosphere.

Product nitrogen gas is withdrawn as gaseous nitrogen from the lower column 2 at the upper part through the conduit 18, a portion of which is used as a reheating nitrogen gas in the reversing heat exchanger 1 through a conduit 19, heat exchanged with the feed air, then joined through a conduit 20 to the remaining portion of the nitrogen gas bypassed through a conduit 21 from the reversing heat exchanger 1, and led through a conduit 22 to the expander 6 for generating subcooling for the apparatus. An expansion turbine is usually used for the expander 6, where the pressure energy of the nitrogen gas is utilized as an external work to generate subcooling for the apparatus.

A pressure controller 8 is provided in the outlet line of the expander 6, and the pressure of product nitrogen gas is adjusted to the predetermined one by bypassing a portion of the effluent nitrogen gas from the expander 6 to the conduit 15 for the waste nitrogen gas through a conduit 23 and a valve 9. When the necessary treating rate of the expander 6 does not meet the product nitrogen gas rate, the product nitrogen gas rate is automatically adjusted also by the bypass line including the pressure controller 8, conduit 23 and valve 9.

The nitrogen gas adiabatically expanded through the expander 6 to the necessary pressure of product nitrogen gas is subcooled, and is led to the heat exchanger 7 such a liquefier, etc. through the conduit 24, heat exchanged with a portion of the feed air branched from the conduit 12 therein, adjusted thereby to a temperature satisfactory for the inlet temperature of the reversing heat exchanger 1, then led to the reversing heat exchanger 1 through the conduit 25, heat exchanged with the feed air therein to recover the temperature up to room temperatue, and taken out through the conduit 26 as a product nitrogen gas.

In the foregoing, one embodiment of the present invention has been described. Control position of outlet pressure of expander 6 (pressure of product nitrogen gas) and its control method can be changed as desired, and a temperature controller can be also used to adjust the inlet temperature condition for the reversing heat exchanger 1.

The foregoing embodiment illustrates the case where the outlet temperature of the expander is lower than the inlet temperature of the reversing heat exchanger, and a fluid for the heat exchanger 7 for adjusting the outlet temperature of expander exclusively determined by the product nitrogen gas pressure to the inlet temperature condition for the reversing heat exchanger can be selected from feed air, liquefied air, liquefied nitrogen, waste nitrogen gas, etc.

Temperature control of the effluent gas from the expander according to the present invention will be described in detail below, referring to FIG. 2.

Figure 2:
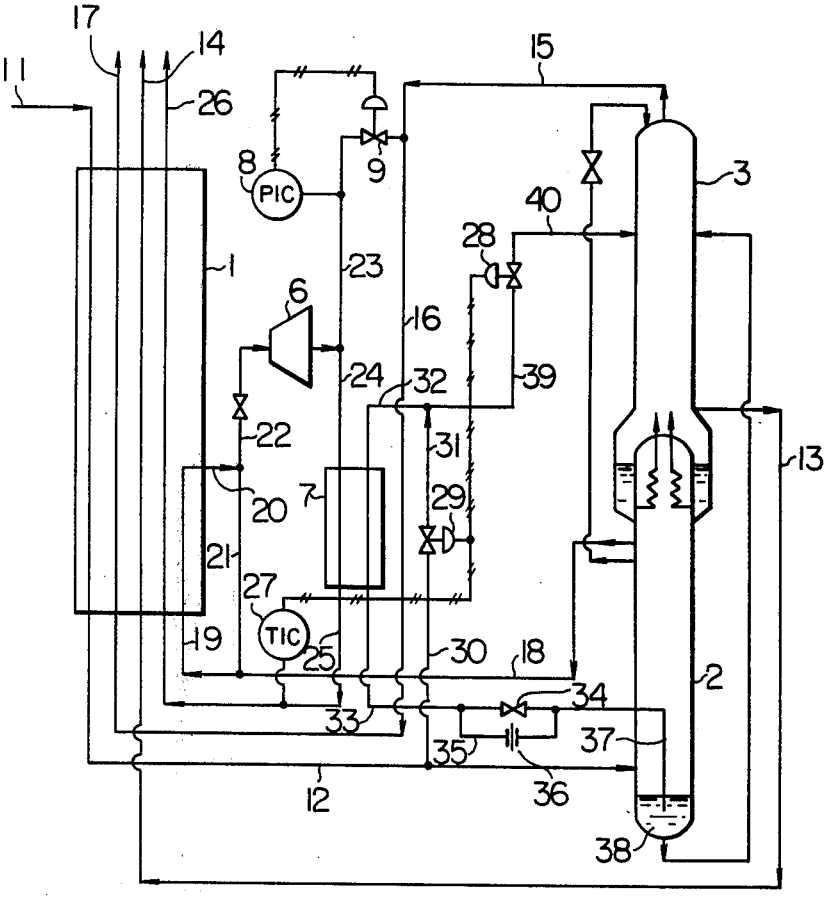
FIG. 2 is a schematic flow diagram showing one embodiment of temperature control of the effluent gas from the expander in a low pressure type air separation apparatus with nitrogen recovery according to the present invention.

In FIG. 2, the same members and members of the same functions as in FIG. 1 are identified by the same reference numerals and same symbols, and description thereof is omitted.

The nitrogen gas adiabatically expanded through the expander 6 to the necessary pressure for the product nitrogen gas is subcooled, and is led to the heat exchanger 7 through the conduit 24, adjusted to the necessary cold end temperature (inlet temperature) of the reversing heat exchanger 1 through heat exchange with the feed air at a higher temperature side or the liquefied air at a lower temperature side, and taken out as the product nitrogen gas from the conduit 26 through the conduit 25 and reversing heat exchanger 26.

To remove water vapor and carbon dioxide gas from the feed air in the reversing heat exchanger 1 by sublimation to prevent the heat exchanger from clogging, it is absolutely necessary to control the low temperature separated gas to the specific temperature (about −177° C.) at the inlet of the reversing heat exchanger.

When the temperature of the nitrogen gas is lowered to less than −177° C. by the adiabatic expansion through the expander 6, the temperature of the nitrogen gas can be adjusted to −177° C. by passing the nitrogen gas through a liquefier where the nitrogen is heat exchanged with the feed air to be supplied to the lower column 2, and the feed air is liquefied thereby. However, in the case that the effluent gas from the expander 6 is taken out under the superatmospheric pressure, or in the case of an air separation apparatus of larger scale, the temperature of the effluent gas from the expander 6 is not always lower than −177° C., that is, sometimes it may be 31 160° C. or higher. When such a gas having a higher temperature is led to the reversing heat exchanger 1, the feed air is not sufficiently cooled, and consequently the carbon dioxide gas is not removed from the feed air before it is fed to the rectification tower. That is, this leads to a clogging accident of the apparatus by dry ice.

In the present invention, a heat exchanger 7 is provided at the outlet side of an expander 6, and a nitrogen gas subcooled by adiatatic expansion through the expander 6 is passed through the heat exchanger through which the nitrogen gas is heat exchanged with the feed air at a higher temperature side or liquefied air at a lower temperature side, thereby controlling the temperature of the nitrogen gas to the necessary inlet temperature for the reversing heat exchanger 1, as described above.

Further explanation will be made below. When the temperature of the effluent gas from the expander 6 is, for example, lower than −177° C., a liquefied air control value 28 is closed by a temperature controller 27, and an air control valve 29 is adjusted to the appropriate degree of opening, and the feed air to be supplied to the lower column 2 is led to the heat exchanger through a conduit 30, valve 29, and conduits 31 and 32. The air cooled in the heat exchanger 7 by the nitrogen gas from the expander 6, liquefied, and led to the lower column 2 through a conduit 33, a check valve 34 and an orifice 36 provided in a conduit 35.

The tip end of the conduit 37 is dipped in the liquefied air 38 retained at the bottom of the lower column 2 to effect liquid sealing. In this manner, the temperature of the effluent gas from the expander is controlled to the necessary inlet temperature for the reversing heat exchanger 1.

When the temperature of the effluent gas from the expander 6 is higher than −177° C. on the other hand, the valve 29 is closed, and the valve 28 is adjusted to the appropriate degree of opening by a signal from the temperature controller 27. The valve 28 is connected to the conduit 32 through the conduit 39 and also to the intermediate level of the upper column 3 through the conduit 40. When the valve 28 is opened, the pressure at the air side of the heat exchanger 7 is lowered, and the liquefied air passing through the check valve 34 is interrupted, whereas the liquefied air 38 at the bottom of the lower column 2, which has been expanded through the orifice 36 and subcooled, is led back to the heat exchanger 7 through the conduits 35 and 33. The liquefied air is gasified through heat exchange with the effluent gas having a higher temperature from the expander 6 and injected into the upper column 3 at the intermediate level through the conduits 32 and 39, valve 28 and conduit 40.

The rate of the liquefied air to be led to the heat exchanger 7 from the lower column 2 is automatically controlled by the degree of opening of the valve 28, and thus the nitrogen gas to be led to the reversing heat exchanger 1 from the heat exchanger 7 is efficiently controlled to the necessary inlet temperature of the reversing heat exchanger 1 through the temperature change and the flow rate change of liquefied air by pressure.

According to the present embodiment of the present invention, a heat exchanger 7 is provided at the outlet side of an expander 6, and the temperature of the effluent gas from the expander 6 is automatically adjusted to the necessary inlet temperature of a reversing heat exchanger 1 through heat exchange with the feed air to be supplied to a lower column 2 when the temperature of the effluent gas from the expander 6 is too low, or through heat exchange with liquefied air from the lower column 2 when it is too high, and thus good temperature control can be made in a simple structure, irrespectively of the scale of an air separation apparatus.

According to the present invention, a product nitrogen gas under the predetermined pressure can be simply recovered in a low pressure type air separation apparatus using a reversing heat exchanger, and also the subcooling generated by the expander can be effectively utilized, as described above. The present invention has a great advantage in power, as compared with the conventional process for pressurizing the low pressure nitrogen gas recovered from the upper column or the conventional process for simply reducing the pressure of a nitrogen gas from the lower column in the course to use end. The present invention also has such a remarkable effect that the temperature of the effluent gas from the expander can be controlled to the necessary inlet temperature of the reversing heat exchanger through one heat exchanger.

What is claimed is:

1. A process for recovering a product nitrogen gas in a low pressure type air separation apparatus provided with a reversing heat exchanger and a duplex type rectification tower having a high pressure column and a low pressure column, which comprises leading a nitrogen gas taken out of said high pressure column of said duplex type rectification tower to an expander for generating subcooling for the air separation apparatus, taking out the nitrogen gas from the outlet of the expander under a pressure higher than the pressure of a nitrogen gas to be taken out of said low pressure column of said duplex type rectification tower, adjusting the temperature of the nitrogen gas from the expander to a necessary inlet temperature for the reversing heat exchanger by passage through a heat exchanger, then passing the temperature adjusted nitrogen gas through the reversing heat exchanger, and taking the nitrogen gas out of the reversing heat exchanger as said product nitrogen gas.

2. A process according to claim 1, wherein the temperature of the nitrogen gas from the expander is adjusted to the necessary inlet temperature for the reversing heat exchanger by heat exchange with feed air to be supplied to the high pressure column of duplex type rectification tower or liquefied air of the high pressure column passed through said heat exchanger, depending upon the degree of the temperature of the nitrogen gas from the expander.

3. A process according to claim 2, wherein the temperature of the nitrogen gas from the expander is adjusted to the necessary inlet temperature of the reversing heat exchanger by heat exchange with feed air to be supplied to the high pressure column of duplex type rectification tower when the temperature of the nitrogen gas from the expander is less than the necessary inlet temperature.

4. A process according to claim 2 or 3, wherein the temperature of the nitrogen gas from the expander is adjusted to the necessary inlet temperature for the reversing heat exchanger by heat exchange with liquefied air of the high pressure column when the temperature of the nitrogen gas from the expander is greater than the necessary inlet temperature.

5. A process according to claim 1 or 2, wherein the pressure of the nitrogen gas from the expander is adjusted so that the product nitrogen gas has a predetermined pressure.

6. A process according to claim 1 or 2, wherein the nitrogen gas rate from the expander is adjusted so that the product nitrogen gas has a predetermined rate.

7. A process according to claim 2, wherein passage of said feed air or said liquefied air through said heat exchanger occurs automatically.

* * * * *